United States Patent [19]

Semon

[11] Patent Number: 4,523,358

[45] Date of Patent: Jun. 18, 1985

[54] STAMPED CASKET

[75] Inventor: William J. Semon, Dalton, Pa.

[73] Assignee: Casket Shells, Inc., Eynon, Pa.

[21] Appl. No.: 468,899

[22] Filed: Feb. 23, 1983

[51] Int. Cl.[3] ..... A61G 17/00

[52] U.S. Cl. ..... 27/6; 29/463; 220/4 B

[58] Field of Search ..... 27/1, 5, 6, 7, 9, 14, 27/26, 2; 29/434, 463; 220/4 B, 4 E, 334, 335; 72/347, 379

[56] References Cited

U.S. PATENT DOCUMENTS

| | | | |
|---|---|---|---|
| 1,375,758 | 4/1921 | Kennedy | 27/6 |
| 1,941,605 | 1/1934 | Johnsen | 27/2 |
| 2,437,141 | 3/1948 | Wallace | 27/6 |
| 2,503,293 | 4/1950 | Paden | 27/6 |
| 3,411,191 | 11/1968 | Ikert et al. | 27/6 |
| 4,320,562 | 3/1982 | Kelley | 27/7 X |
| 4,360,953 | 11/1982 | Angermann | 27/14 |

FOREIGN PATENT DOCUMENTS

| | | | |
|---|---|---|---|
| 22940 | 2/1906 | Austria | 27/6 |
| 2003429 | 8/1971 | Fed. Rep. of Germany | 27/7 |

*Primary Examiner*—Richard J. Johnson

*Attorney, Agent, or Firm*—Kane, Dalsimer, Kane, Sullivan and Kurucz

[57] ABSTRACT

A casket having a base or body produced by a single press of a forming stamp, and a top or cap also formed by a single press of a forming stamp. The base or body may be formed by the same tooling as the top or cap reducing the equipment necessary, time of production and labor costs in manufacture of the casket shell.

9 Claims, 12 Drawing Figures

STAMPED CASKET

BACKGROUND OF THE INVENTION

This invention pertains to an improved casket having a single press formed base or body, and a stamped top or cap.

In the manufacture of metal caskets, and particularly casket made of various grades of sheet steel or paneling, a relatively large number of manipulative steps are required, many of which necessitate the intervention of considerable manual labor. Consequently, the manufacturing cost of metal caskets is relatively high. Accordingly, it would be of extreme benefit to the industry to reduce the cost of casket manufacture by minimizing the various steps in the manufacturing process, and, of course, the intervention of manual labor.

Normally, when manufacturing metal caskets of steel sheets or paneling, the component parts will be subject to a number of stamping operations requiring various tooling configurations. The stamped casket parts include a top cap or lid, the side and end panels, and the bottom. The side and end panels will be initially tack welded to one another and squared. After squaring, the bottom, sides, and ends will be welded to one another. If the casket is what is termed in the trade an "non-sealer", only the top and bottom rails of the side and end panels will be completely welded to one another to provide a hermetic joint or juncture at this location. Later assembly process decorative hardware will be applied to the corners over the sections that are merely tack welded to one another. Then a corner piece may be added or a "Hammond-type" metal strip applied to the corners between the top and bottom rails. In the event a "sealer" casket is being manufactured, the entire corner including the top and bottom rails and the section therebetween will be completely welded.

The welded corners will be subjected to a grinding opearation followed by buffing and fine finishing to obtain the desired aesthetic appearance. An alternative to grinding and finishing is the addition of a casket corner piece. The top or cap is then assembled. Following assembly the entire casket is passed through a cleaning operation followed by an application of primer and paint to obtain the appropriate decorative appearance. Selected hardware for both the exterior and interior is applied and the interior is suitably trimmed with liners, cloth and other materials.

As can be seen, the above described method of casket manufacture is both complicated, labor intensive coupled with lengthy production times resulting in costly caskets.

SUMMARY OF THE INVENTION

The primary object of the present invention is to achieve ultimate simplicity in casket manufacture. Accordingly, it is an object of the present invention to minimize the steps involved and the resources needed in the casket manufacturing process by utilizing a one-piece casket base or body formed by stamping or pressing operation of a forming stamp, and a one-piece casket top cap, or lid also formed by a stamping process. In this manner, separate stamping processes and dies for side panels, end panels, casket bottom, and top cap or lid are eliminated with considerable savings in production time and labor costs. Additionally, equipment and skilled labor requirements are reduced. The tooling used in forming the top or cap and the base or body may be of substantially identical configuration, or of non-identical configurations. If substantially identical tooling is used in forming the top and base, the resulting casket will consist of a stamped cap or lid as the casket top, and an inverted stamped cap or lid as the casket base.

Another object of this invention is to minimize the steps involved and the manual labor needed for squaring, welding and sealing at joints or junctions of the casket body components, including: the side panels, the end panels, and the casket bottom. This is accomplished by utilizing the aforementioned casket body, produced by a single stamping die, as a casket base. The result is a joined, watertight, airtight casket base with considerable savings in production time and manual labor costs.

It is another object of the present invention to provide a casket which is especially suitable to use for mass disaster victims, quarantine diseases, drowned, mutilated, burned or decomposed corpses. Additionally the stamped casket is particularly apt in use for; transfer and shipping, autopsy, disinterment, immersion and placement in a holding vault.

A further object is to provide a functional, economical affordable casket.

A still further object is to provide a casket which requires less space, with consequent advantages in shipping or storing that is stream-lined and aesthetically pleasing and acceptable.

These and other objects and advantages will become apparent from the following detailed description which is to be taken in conjunction with the accompanying drawings.

DETAILED DESCRIPTION OF THE PREFERRED EMBODIMENT

Figure 1:
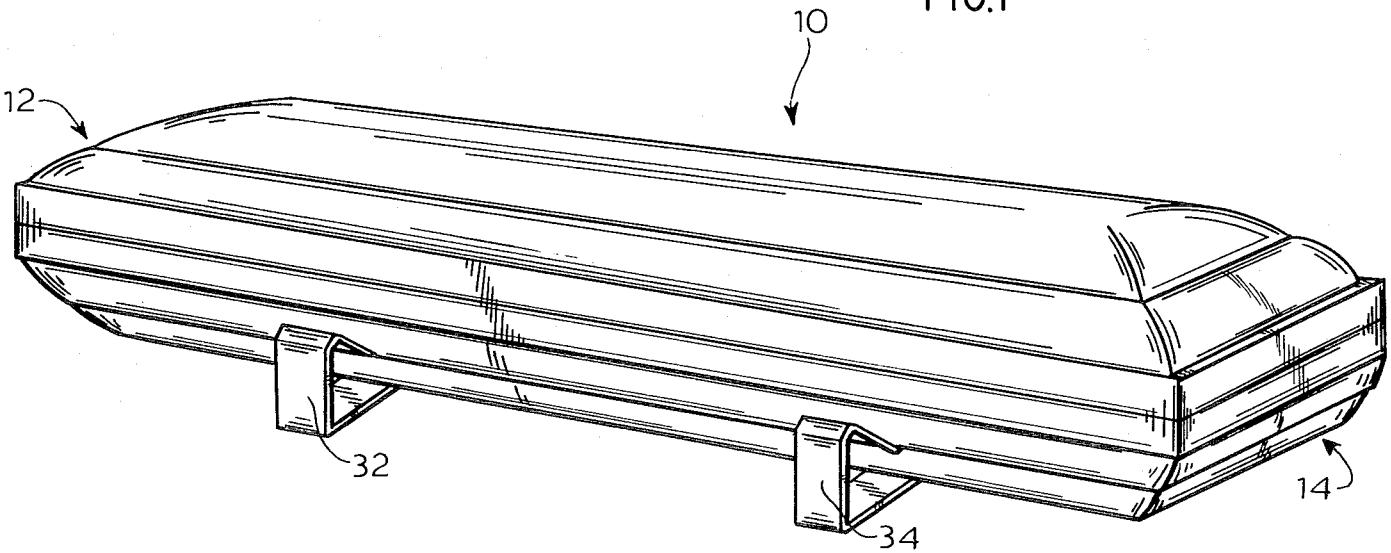
FIG. 1 is a perspective view of the casket incorporating the teachings of the present invention.
Figure 4:
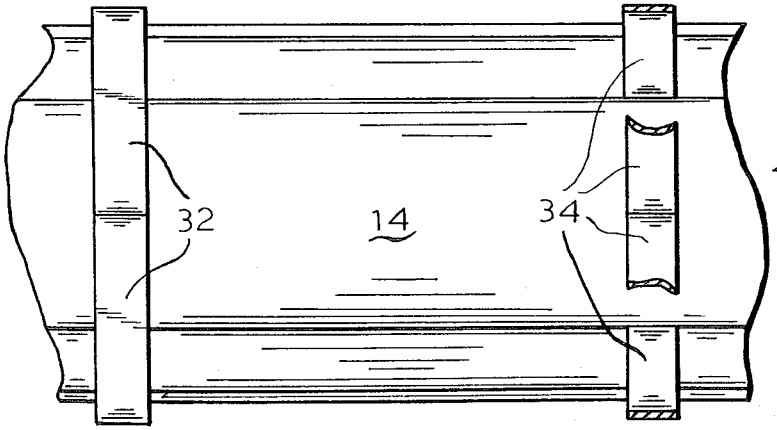
FIG. 4 is a partial bottom view of the casket shown along the lines 4—4 of FIG. 3.

In the drawings, a casket 10 incorporating the present invention, is shown.

The casket may be made of any suitable materials, e.g., various grades of steel, zinc coated steel, copper, bronze etc.

The casket consists of a top or cap 12 and a base 14. To minimize production steps the same forming stamp may be used to make casket top 12 and the casket base 14.

Figure 3:
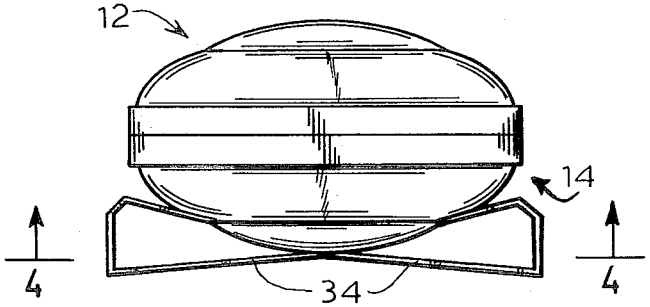
FIG. 3 is an end longitudinal view of the casket.
Figure 2:
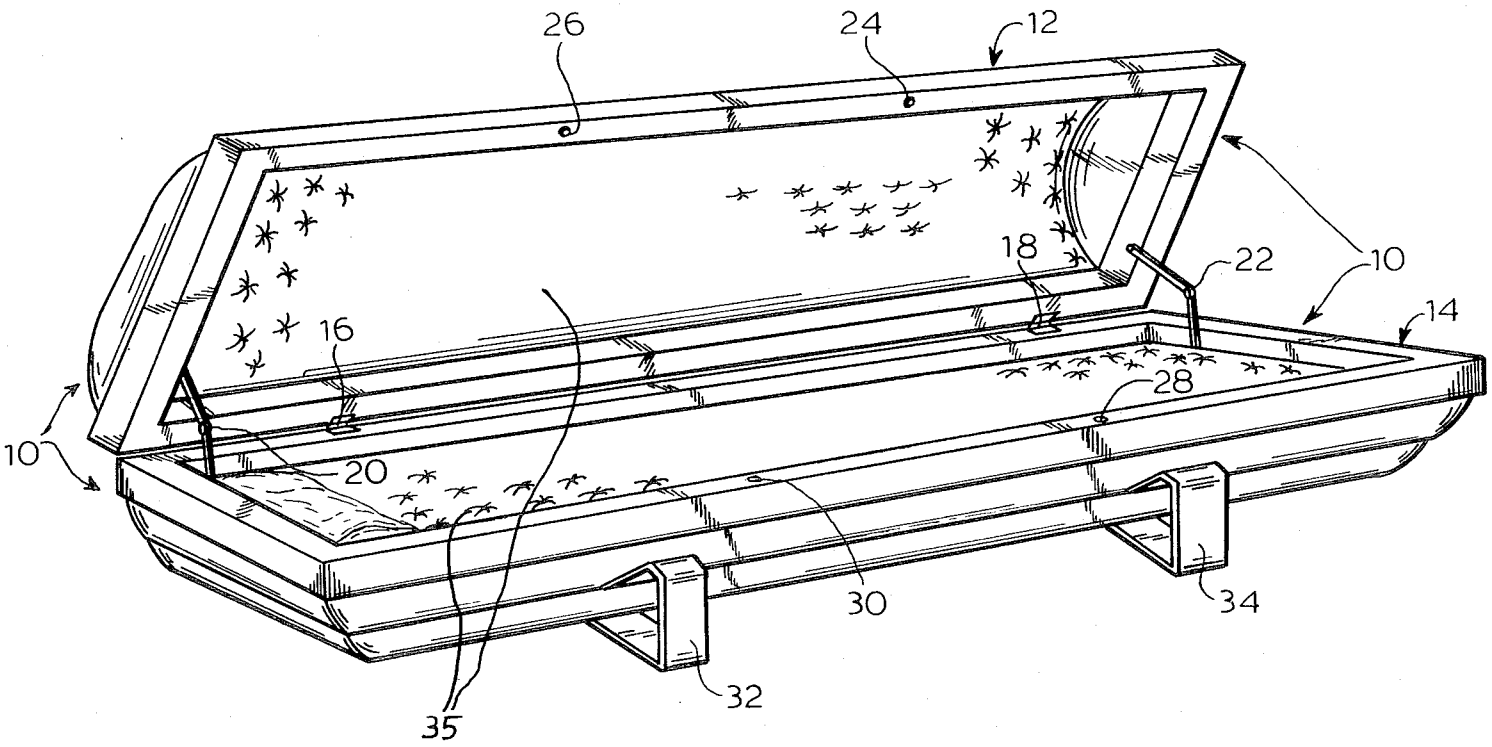
FIG. 2 is a perspective view of the casket with the cap in an open position.

The top or cap is comprised of a rectangular frame and a hollowed out inner shell. The hollow inner shell has the form of a half oval or half capsule, as shown in FIG. 3, which shape is maintained for the length of the casket top. The top is composed of an integral material throughout. The base or body 14, is comprised of a rectangular frame and a hollowed out inner shell. The inner shell may have a substantially identical form as the top or cap. The hollowed out inner shell of the base or body may take an alternate form (e.g., right parallelepiped) by the use of non-identical tooling. The base or body is composed of an integral material throughout. The top and base section have integral generally horizontal flanges extending inwardly from the edges of the top and bottom to form opposing generally parallel surfaces when the top is lowered.

Figure 12:
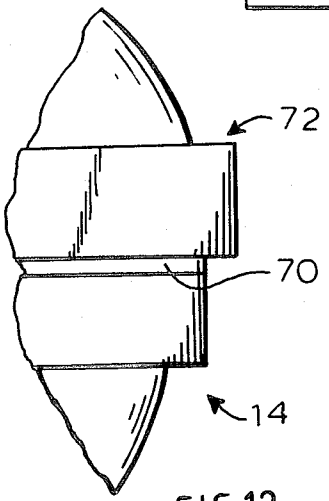
FIG. 12 is an enlarged section of the top and bottom showing a gasket therebetween.

Connecting casket top 12 to casket base 14 are conventional hinges 16 and 18, and arm supports 20 and 22. Outside pin hinges 16 and 18 may be used, or alternatively, internal concealed hinge(s) may be applied to the casket. It may be found necessary, in order to accomodate the hinge and closing means, to make the lateral size of the casket top 72 slightly larger than that of the casket base (see FIG. 12). Typical lever locks 24 and 26 are mounted on casket top 12 and aligned with lever lock receptacles 28 and 30 on casket base 14. Alternately, snap locks, which are readily adapted to use on a non-sealer casket, may be used. A crank lock means may be used including an end crank or an internal crank lock. Base stands 32 and 34 are mechanically fixed to the casket base 14. Base stands 32 and 34 may be affixed permanently or so as to be removable from casket base 14 if desired.

Base stands 32 and 34 have a front section, extending below the front (viewing) side of the casket, each section of the base stand having a front portion, 36, extending away from the casket base, a second bar portion, 38, which is bent, and a third bar portion, 40, extending to, and mechanically affixed to the casket base. This may be accomplished by spot welding, nuts and bolts, or other conventional affixing means. A selected lining 35 is then set into casket base 14.

Figure 11:
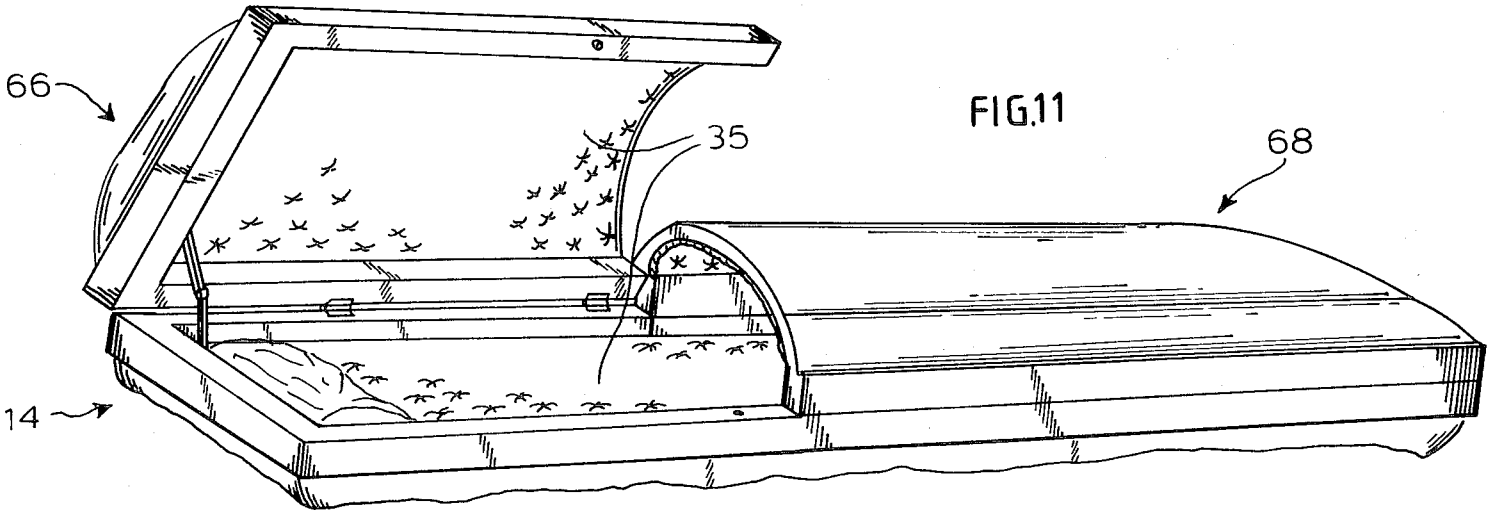
FIG. 11 is a perspective view showing the "half couch" casket.

A "half couch" casket allowing viewing, as illuminated in FIG. 11, may be made by cutting casket top 12 into two parts, 66 and 68, which may be independently opened, or alternatively by affixing a casket top having two parts, 66 and 68, to casket base 14. Headers and/or bridges are normally associated with the perfection type of lid. A perfection type of lid having headers and/or bridges may be used on both the foot end and the head end in FIG. 11. Slight redesign to allow desired levels of viewing of the deceased and to allow proper fit of the deceased into the casket will be required when the perfection type of lid having headers and/or bridges are used.

Figure 5:
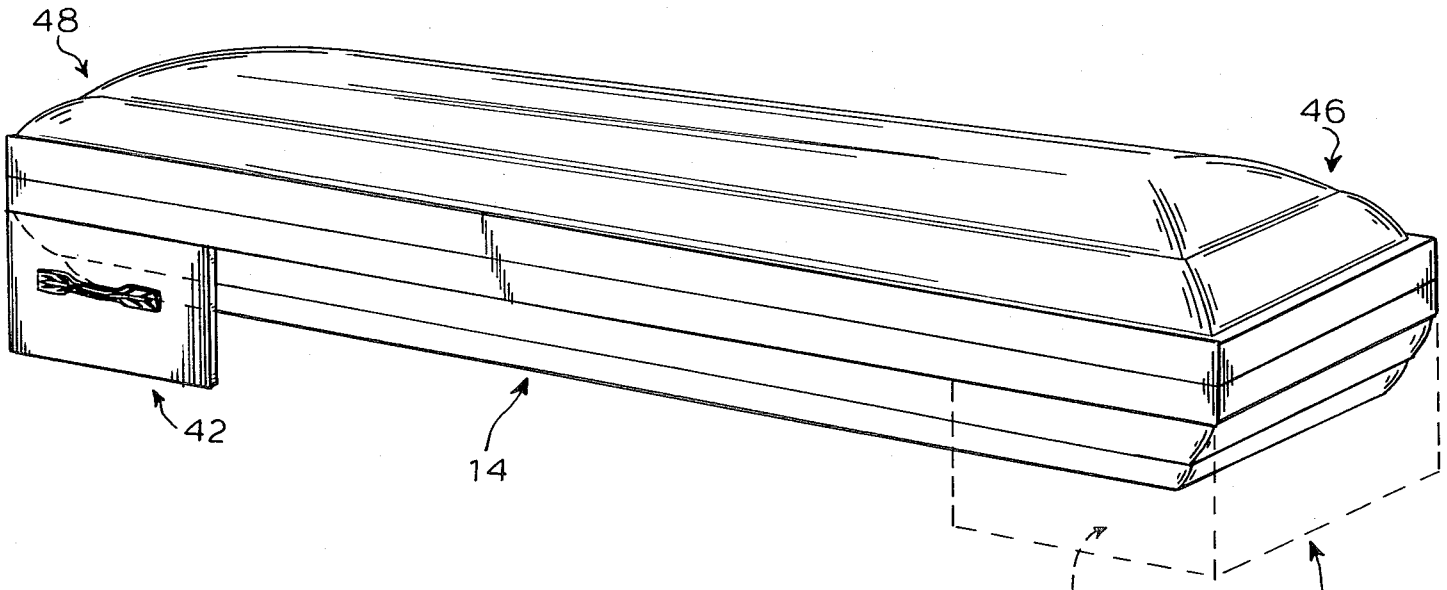
FIG. 5 is a perspective view of an embodiment of the present invention incorporating two three sided casket end stands, one end stand shown in phantom.
Figure 6:
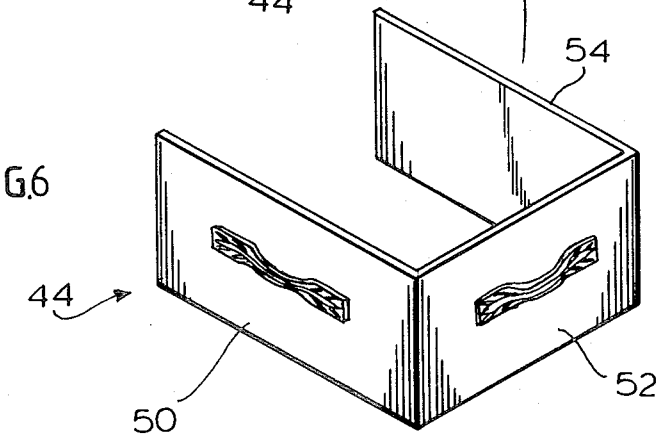
FIG. 6 is perspective view of a three sided end stand disconnected from the casket base.

An alternate casket support means, as illustrated in FIGS. 5 and 6, includes a three sided casket end stand, 44 mechanically affixed to casket base 14 at the head end 46 of the casket and one three sided end stand 42 mechanically affixed to casket base 14 at the foot end 48 of the casket. Each end stand has three sections, end stand 44 having section 50 affixed adjacent to, and supporting, the front side of the casket base toward the head end 46 of the casket, a second section, 52, is affixed adjacent to and supporting the head end 46 of casket base 14, and a third section, 54, of the end stand is affixed adjacent to and supporting the back side of casket base 14 toward the head end 46 of the casket. In this embodiment handles may be affixed to the sides of end stands 42 and 44, or alternately, to the sides of the casket itself.

Figure 7:
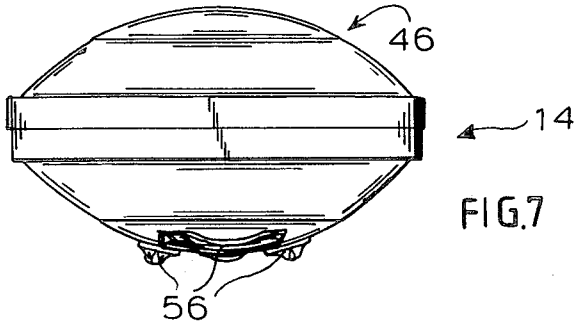
FIG. 7 is an end longitudinal view of an embodiment of the present invention incorporating elongated handles for support and carrying of the casket.
Figure 8:
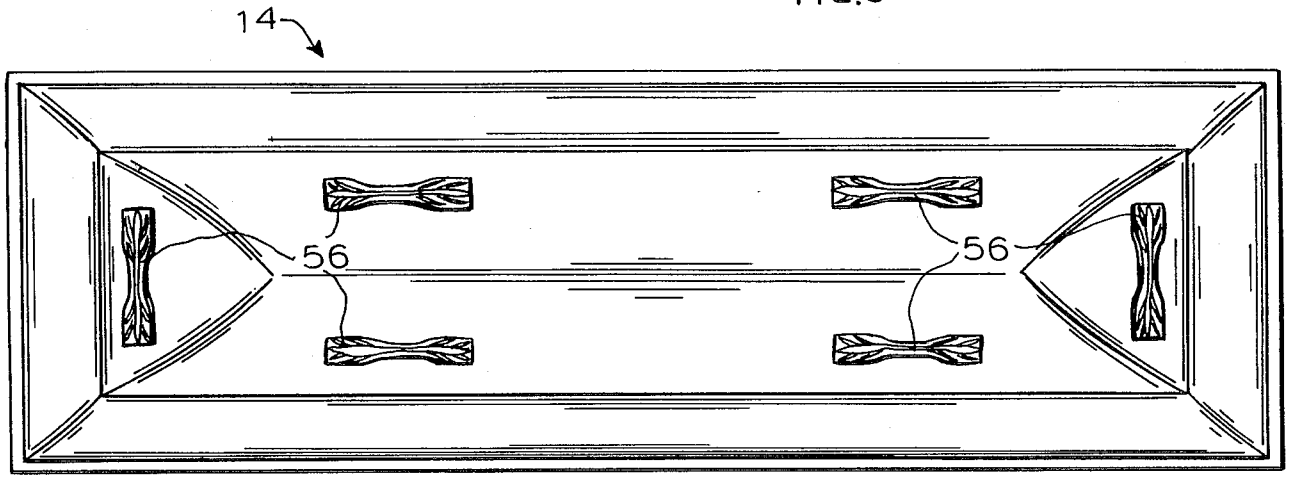
FIG. 8 is a bottom view of the casket base illustrating the elongated handles affixed to the casket base.

An additional alternative support means is illustrated in FIGS. 7 and 8 comprising six elongated handles, 56, mechanically affixed to the underside of casket base 14. The elongated handles 56 extend below casket base 14 to a point on a common plane so as to support the casket when it is on a flat, level surface.

Figure 9:
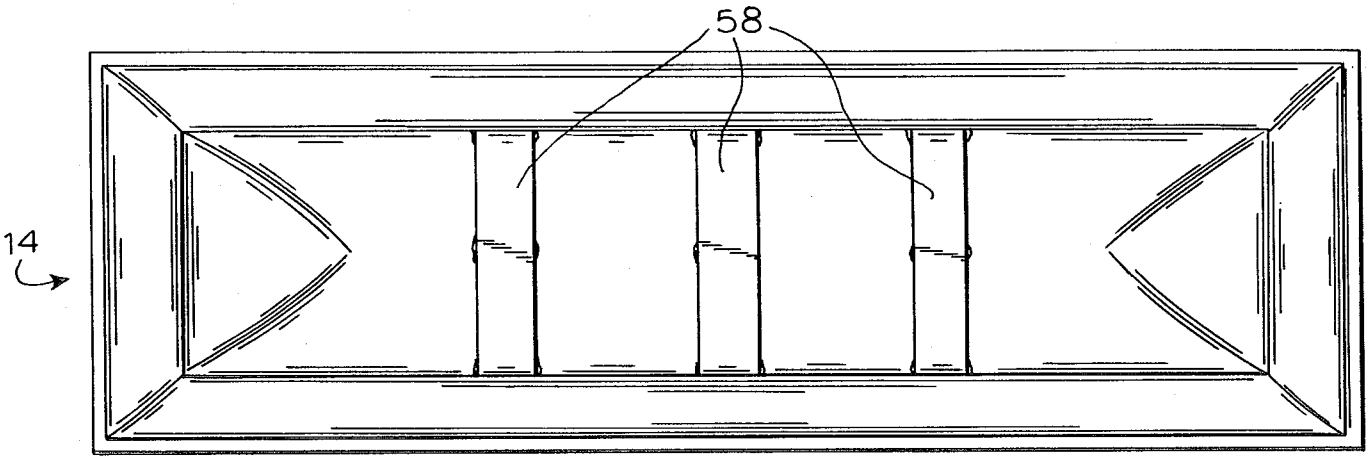
FIG. 9 is a bottom view of an embodiment of the present invention showing three base stand pieces to support the casket.
Figure 10:
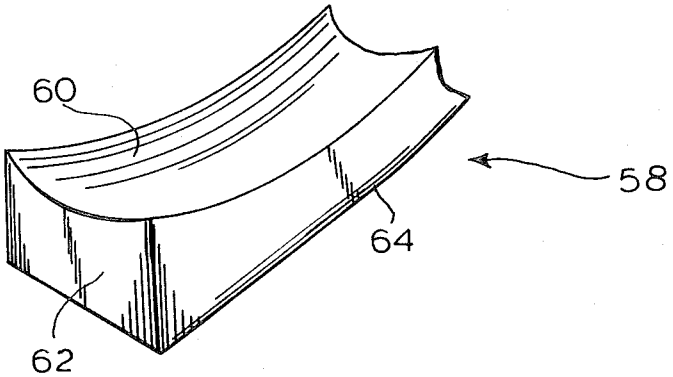
FIG. 10 is a perspective view of a base stand piece.

FIG. 9 illustrates a casket support means comprising three base stand pieces, 58, mechanically affixed to the underside of the casket base, transversely to the length of the casket, having a top 60 curved to fit the curved underside of casket base 14, a solid body portion 62, and a flat bottom part 64 to support the casket.

The present invention contemplates the addition of other conventional, decorative, or functional hardware if so desired. A finish, to obtain the desired aesthetic appearance may also be applied to the casket.

A casket sealing gasket device 70 (FIG. 12) may be used. The gasket means may be composed of rubber or other suitable material. A casket sealing gasket comprising a continuously sealed joint about the entire casket periphery and achieving an airtight/watertight seal when the lid is closed may be desired.

Thus it will be evident that the present invention realizes the object of ultimate simplicity in casket manufacture consisting of an affordable, economical, functional casket which eliminates many of the steps required in traditional casket manufacture. Thus the several aforenoted objects and advantages are more effectively attained. Although a preferred embodiment of the invention has been disclosed and described in detail herein, it should be understood that this invention is in no sense limited thereby and its scope is to be determined by that of the appended claims.

What is claimed is:

1. A casket comprising a one-piece pre-formed generally rectangular stamped body to be used as a base having an integrally formed bottom, sides and ends, and a one-piece pre-formed stamped cap having an integrally formed top, sides and ends to be used as a top, an integral generally horizontal flange extending inwardly from the periphery of the top and bottom sections in adjacent opposed relationship, hinges pivotally coupling the cap to the body and closing means for closing the cap to the body, said base and said cap being of substantially identical size and configuration and the cap being slightly larger in plan than the body to accommodate the hinges and closing means.

2. The invention in accordance with claim 1 wherein said cap is cut into two parts creating a seam in the cap.

3. The invention in accordance with claim 1 including a plurality of base stands mechanically affixed to the underside of the casket base transversely to the length of the casket so as to support the casket, having a front section extending below the front side of the casket base and a back section extending below the back side of the casket base, each section of the base stand comprising a bar having a first portion extending away from the casket base, a second bar portion which is bent, and a third bar portion extending to, and mechanically affixed to, the casket base.

4. The invention in accordance with claim 1, further comprising; one three sided casket end stand mechanically affixed to the casket base at the head end of the casket, and one three sided casket end stand mechanically affixed to the casket base at the foot end of the the casket, each end stand having three sections, one section affixed adjacent to, and supporting the front side of the casket base toward the end of the casket, a second section affixed adjacent to and supporting the end of the casket base, and a third section of the end stand affixed adjacent to and supporting the back side of the casket base toward the end of the casket.

5. The invention in accordance with claim 1, further comprising a plurality of elongated handles mechanically affixed to the underside of the casket base, in order to support the casket, at least one handle is affixed at a head end of the casket base, at least one handle is affixed at a foot end of the casket base, at least one handle is affixed to a front side of the casket base, and at least one handle affixed to a back side of the casket base.

6. The invention in accordance with claim 1, further comprising a plurality of base stand pieces mechanically affixed to the underside of the casket base, transversely to the length of the casket, having a top part curved to fit the curved underside of the casket base, a solid body portion, and a flat bottom part to support the casket.

7. The invention in accordance with claim 1, further comprising a lining set into the casket.

8. The invention in accordance with claim 1, including: a lining set into the casket base, a hinge means hingedly coupling said top and base together, a base stand affixed to the casket base to support the casket, an arm support affixed to the interior of both the casket base and the casket top at each of the casket ends, and lock means to lock the casket top to the casket base.

9. The invention in accordance with claim 1, wherein a gasket means is interposed between the cap and body to seal the juncture therebetween.

* * * * *